US005651847A

United States Patent [19]

Loeffler

[11] Patent Number: 5,651,847

[45] Date of Patent: Jul. 29, 1997

[54] DOUBLE-FACE CIRCULAR KNIT

[75] Inventor: Alfons Loeffler, Bobingen, Germany

[73] Assignee: Hoechst AG, Germany

[21] Appl. No.: 195,859

[22] Filed: Feb. 10, 1994

[30] Foreign Application Priority Data

Feb. 12, 1993 [DE] Germany ..... 93 02 039 U

[51] Int. Cl.[6] ..... B60R 13/01; B68G 11/00; D04B 9/06; E04F 13/00

[52] U.S. Cl. ..... 156/71; 29/91.1; 66/19; 66/196; 296/39.1; 428/219; 442/308; 442/318

[58] Field of Search ..... 66/196, 19; 428/253, 428/219, 225; 29/91.1; 156/71; 296/39.1

[56] References Cited

U.S. PATENT DOCUMENTS

| | | | |
|---|---|---|---|
| 2,067,739 | 1/1937 | Tanski . | |
| 5,166,480 | 11/1992 | Bottger et al. . | |
| 5,334,442 | 8/1994 | Okanoto | 428/246 |

FOREIGN PATENT DOCUMENTS

| | | |
|---|---|---|
| 0339227 | 11/1989 | European Pat. Off. . |
| 28 51 348 | 6/1970 | Germany . |
| 90 16 062.2 | 2/1991 | Germany . |
| WO92/13125 | 8/1992 | WIPO . |

OTHER PUBLICATIONS

European Search Report, No. 94101798.0, Jun. 20, 1994.

*Primary Examiner*—James C. Cannon
*Attorney, Agent, or Firm*—Connolly & Hutz

[57] ABSTRACT

There is described a double-face circular knit comprising two concentric lengths of knit web and an in-between spacer structure, wherein the spacer threads are optionally textured coarse-filament multifilament yarns, optionally in combination with monofilaments, the distance between the two lengths of knit web is from 0.3 to 8 mm, the stitch density corresponds to a machine gauge from E 16 to E 32, and the density of the spacer threads is between 150 and 250 threads per $cm^2$. Preferably all the yarns of the double-face circular knit are made of the same polymer.

Also described are the production and use of this double-face circular knit.

18 Claims, 4 Drawing Sheets

DOUBLE-FACE CIRCULAR KNIT

Figure 1:
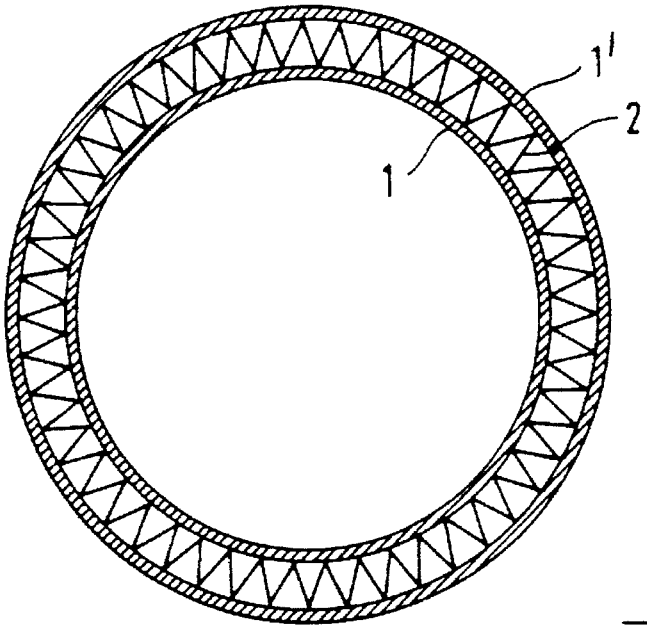

The present invention relates to a double-face circular knit comprising two outside lengths of knit web and an in-between spacer structure, preferably for upholstery and lining purposes, representing a particularly advantageous combination of springback behavior, textile surface hand and formability.

German Utility Model G 90 16 062 discloses using, for the purpose of upholstering seating furniture and garments and as an underlay for hospital beds, a textile spacer knit which has an improved form stability and permanent springback properties. The spacer structure consists of loops of elastic monofilaments which intermesh alternately with the webs and thus bind them together. The monofilaments forming the loops binding the webs together and hence acting as spacer threads are intended to have a thickness from 0.08 to 0.14 mm when the distance between the fabrics is about 7 mm. Similarly, the double-face warp-knit material disclosed in DE-C-28 51 348 was intended to create a springingly soft sheet suitable for bed underlays. There this object was achieved by constructing the back springing of the upper length of knit web in the form of spacer ribbons from plastics film strips about 0.1 mm in thickness and 1–3 mm in width. These spacer ribbons were preferably made of polypropylene.

However, the known constructions have defects which prevent their wider use.

One factor which is gaining increasing importance is the need for satisfactory disposal of used materials. The use in known double-face textile materials of different materials for the yarns of the length of knit web and for the spacer structure, for example polyamide yarns for the knit web and polypropylene for the spacers, is an appreciable disadvantage when it comes to disposing of these materials.

A further limiting factor is the need for the spacers used to be film tape or monofilaments. These materials are not manufactured on as large a scale as textile synthetic fibers. Their manufacture and further processing is technically complicated because of their characteristic stiffness, and hence costly. The hitting of such stiff filamentary materials into textile knits presents problems, the severity of which increases with the proportion of these materials in the textile product as a whole.

A further property of these known materials, which is a serious disadvantage in various applications, is the harshness of the textile surfaces, which feel cold and uncomfortable, and finally the reduced formability, which makes it difficult to fit the double knits to three-dimensional structures and hence limits their use for clothing purposes.

It has now surprisingly been found that the below-described spacer knit can be used to bring about a significant improvement in the formability, the tactile properties of the textile surface and at the same time to simplify and reduce the cost of manufacture and facilitate disposal through recycling.

The present invention thus provides a double-face circular knit comprising two concentric lengths of knit web and an in-between spacer structure, wherein the spacer threads are optionally textured coarse-filament multifilament yarns, optionally in combination with monofilaments, the distance between the two lengths of knit web is from 0.3 to 8 mm, the stitch density corresponds to a machine gauge from E 16 to E 32, and the density of the spacer threads is between 150 and 250 threads per $cm^2$.

The optionally textured coarse-filament multifilament yarns present in the double-face circular knit of the invention have a yarn linear density from 50 to 250 dtex, preferably from 100 to 200 dtex, and a filament linear density from 5 to 100 dtex, preferably from 10 to 20 dtex.

The monofilaments present in the double-face circular knit have a linear density from 20 to 150 dtex, preferably from 70 to 110 dtex.

Preferably all the yarns for the double-face circular knit are made of the same polymer material.

The double-face circular knit of the invention contains as the spacer threads optionally textured coarse-filament multifilament yarn and, optionally combined therewith, monofilaments. The spacer construction can thus consist of coarse-filament multifilament yarn, in particular textured coarse-filament multifilament yarn, exclusively or else, which has certain below-described advantages, additionally include a proportion of monofilaments.

Preferably the double-face circular knit of the invention has a plain construction.

The term plain construction also comprehends the variants thereof, such as plated, openwork, ribbed, shogged, wave, tuckwork, knob and Jacquard patternings.

A preferred double-face circular knit according to the present invention has a basis weight from 150 to 1400 $g/m^2$, preferably from 200 to 500 $g/m^2$, and the vertical distance between its two lengths of knit web is from 0.3 to 8 mm, preferably from 4 to 6 mm. Preference is further given to a double-face circular knit according to the present invention in which the lengths of knit web have a stitch density which corresponds to a machine gauge from E 18 to E 20.

The use in the spacer construction of coarse-filament multifilament yarn, in particular textured coarse-filament multifilament yarn, results in particular advantages such as an appreciably improved formability and more pleasant tactile properties, but also for the overall simplicity of production and cost of the material.

A particularly advantageous combination of springback behavior and textile surface hand and formability is obtained when from 50 to 80% by weight, preferably from 60 to 70% by weight, of the spacer threads are optionally textured coarse-filament multifilament yarns and correspondingly from 20 to 50% by weight, preferably from 30 to 40% by weight, are monofilaments.

The arrangement of the optionally textured coarse-filament multifilament yarns and of the monofilaments in the spacer structure can take various forms. The essential requirement is that the monofilaments and the optionally textured coarse-filament multifilament yarns are randomly uniformly mixed and distributed over the area of the spacer hit.

One advantageous arrangement is for the monofilaments and the optionally textured yarns to be interlaced or intermeshed in the spacer structure side by side in every course.

A further advantageous arrangement is for the optionally textured coarse-filament multifilament yarns and the monofilaments to alternate with each other in the spacer structure.

Particular stabilization against sideways slippage and collapse of the two lengths of hit web results when the spacer threads made of optionally textured coarse-filament multifilament yarn and monofilaments alternate between the courses extending in one direction. Advantageously the spacer construction has a thread density from in total 150 to 250, preferably from 180 to 200, spacer threads per $cm^2$.

The monofilament spacer threads advantageously have a linear density from 20 to 150 dtex, preferably from 70 to 110 dtex, while the optionally textured coarse-filament multifilament yarn spacer threads advantageously have a yarn linear density from 50 to 250 dtex, preferably from 100 to 200 dtex, and a filament linear density from 5 to 100 dtex, preferably from 10 to 20 dtex.

Textured multifilament yarns used as spacer threads have been air or false twist textured.

FIGS. 1, 2, 3, 4*a* and 4*b* diagramatically illustrate two embodiments of the double-face circular knit according to the present invention by way of example.

FIG. 1 is a diagrammatic representation of a cylindrically shaped double-face circular knit comprising the two concentric lengths of knit web (1) and (1') and the spacer threads (2) which Join them together and are indicated as a zigzag line.

Figure 2:
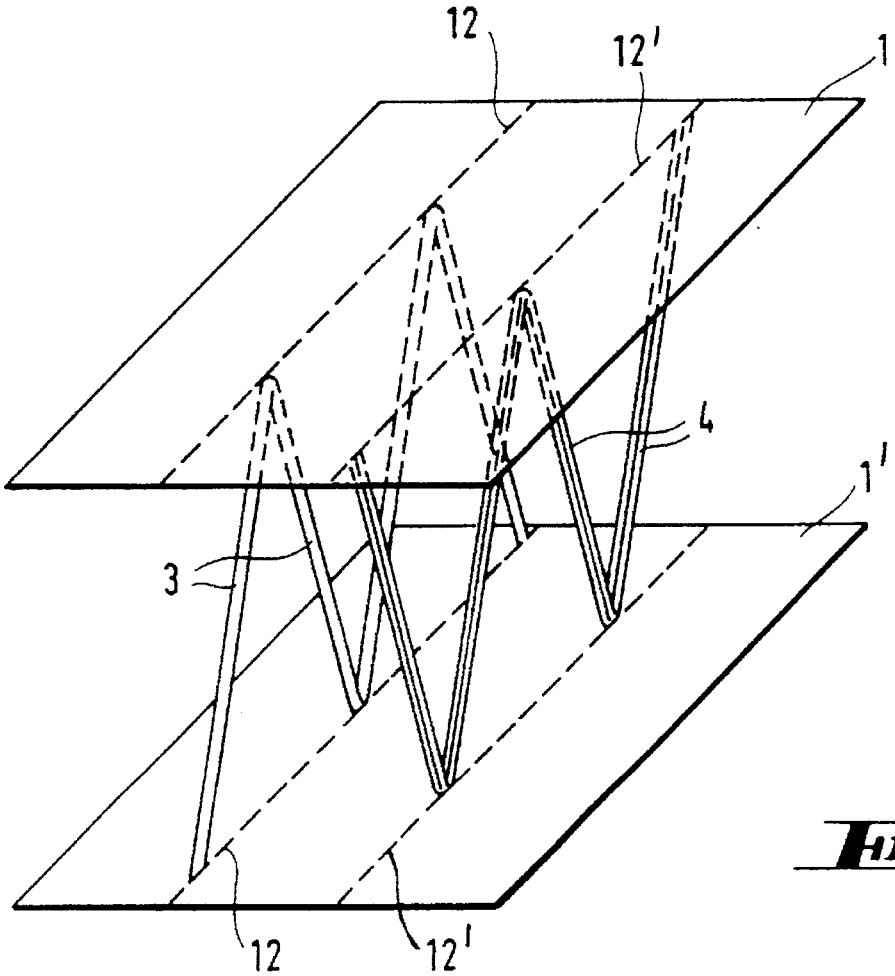

FIG. 2 shows a detail from an elevated perspective of a double-face circular knit according to the present invention with the two lengths of knit web (1) and (1') on the outside, the dots thereon indicating the direction lines (12) and (12') for the position of the wales, and the monofilament (3) and textured multifilament yarn (4) spacer threads passing back and forth between the lengths of knit web (1) and (1'). In this example the monofilaments and the textured multifilament yarns are interlaced or intermeshed side by side in every course.

Figure 3:
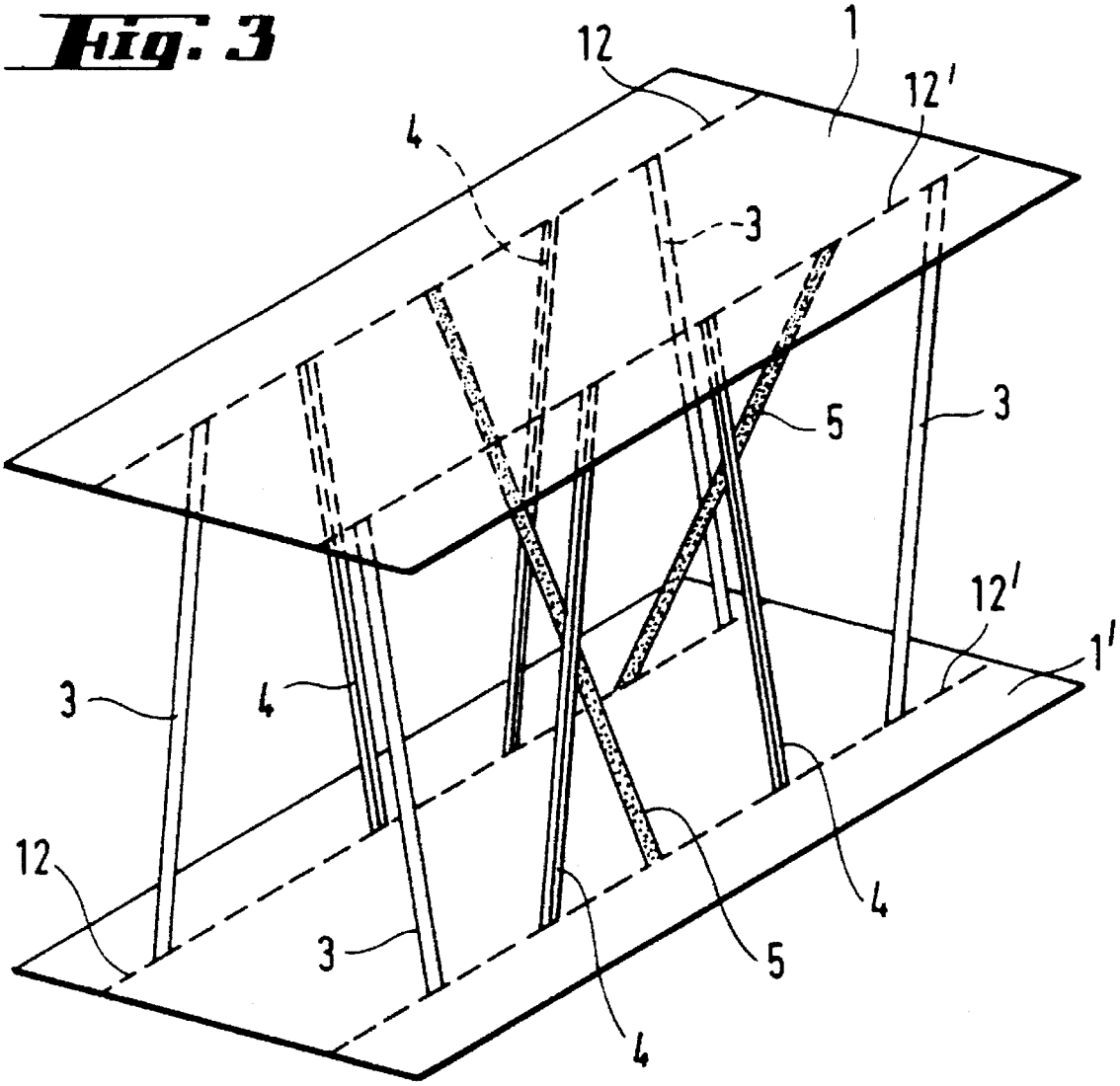

FIG. 3 shows a detail from an elevated perspective of a double-face circular hit according to the present invention, with the two lengths of knit web (1) and (1') on the outside, the dots thereon indicating the direction lines (12) and (12') for the position of the wales, and the monofilament (3) and textured multifilament yarn (4) spacer threads passing back and forth between the lengths of knit fabric (1) and (1'), and also the spacer threads (5) which extend between adjacent wales and which are shown as stippled lines for clarity. In this example the monofilaments and the textured multifilament yarns are interlaced or intermeshed into the knit web alternatingly in every knitting direction and the result is transverse stabilization through the threads (5) which alternate between the wales.

The yarns of the two lengths of knit web and the monofilaments and optionally textured yarns of the spacer construction are preferably made of polyesters or polyolefins.

The polyester material can in principle be any type suitable for fibermaking. Suitable polyesters of this type predominantly comprise building blocks derived from aromatic dicarboxylic acids and from aliphatic diols. Widely used aromatic dicarboxylic acid building blocks are the bivalent radicals of benzenedicarboxylic acids, in particular terephthalic acid and isophthalic acid; widely used diols have 2–4 carbon atoms, and ethylene glycol is particularly suitable. Modified polyesters preferably contain at least 85 mol % of ethylene terephthalate units. The remaining 15 mol % are then made up of dicarboxylic acid units and glycol units, which act as modifiers and make it possible for the skilled person to influence the physical and chemical properties of the filaments in a specific manner. Examples of such dicarboxylic acid units are radicals of isophthalic acid or of aliphatic dicarboxylic acids such as glutaric acid, adipic acid, sebacic acid; examples of modifying diol radicals are those of longer-chain diols, for example of propanediol or butanediol, of di- or triethylene glycol or, if present in a small amount, of polyglycol having a molecular weight of about 500–2000. Particular preference is given to polyesters which contain at least 95 mol % of ethylene terephthalate units, in particular to polyesters made of unmodified PET.

The spacer fabrics of the present invention which are made of such polyesters, in particular of polyethylene terephthalate, do not flame easily.

The flame-resistant effect can be enhanced by the use of polyesters which have been modified to be flame-resistant. Such modified flame-resistant polyesters are known. They contain additions of halogen compounds, in particular bromine compounds, or, particularly advantageously, of phosphorus compounds condensed into the polyester chain. Particularly preferred flame-resistant spacer fabrics according to the present invention contain monofilaments and yarns of polyesters which contain, condensed into the chain, groups of the formula

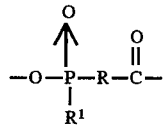

(I)

where R is alkylene or polymethylene having 2 to 6 carbon atoms or phenyl and $R^1$ is alkyl having 1 to 6 carbon atoms, aryl or aralkyl.

Preferably, in the formula (I), R is ethylene and $R^1$ is methyl, ethyl, phenyl or o-, m- or p-methylphenyl, in particular methyl.

The polyesters present in the double-face circular knit of the present invention advantageously have a molecular weight corresponding to an intrinsic viscosity (IV) measured in a solution of 1 g of polymer in 100 ml of dichloroacetic acid at 25° C., from 0.5 to 1.4.

Suitable polyolefins for the yarns of the double-face circular knit according to the present invention include not only unsubstituted but also substituted, in particular chlorine- or cyano-substituted, polyolefins. Examples of such polyolefin materials are polyethylene, polypropylene, polyvinyl chloride and polyacrylonitrile. Preferred polyolefin yarns are made of polypropylene.

As used herein, the term "circular knit" comprehends any kind of circular weft-hit, whether made using independently movable needles or fixed needles, and does of course also comprehend pulled-wide knit hoses.

The present invention further provides a process for producing the above-described double-face circular knit by producing, on the two rows of needles of the cylinder and dial of a circular hitting machine with independently movable needles, a double-face circular knit in which the spacer threads are guided alternatingly back and forth between the two lengths of knit web and are interlaced or intermeshed into each length of web, which comprises feeding the needles of the corresponding knitting systems with spacer threads comprising either optionally textured coarse-filament multifilament yarns or optionally textured coarse-filament multifilament yarns alternating with monofilaments.

Figure 4A:
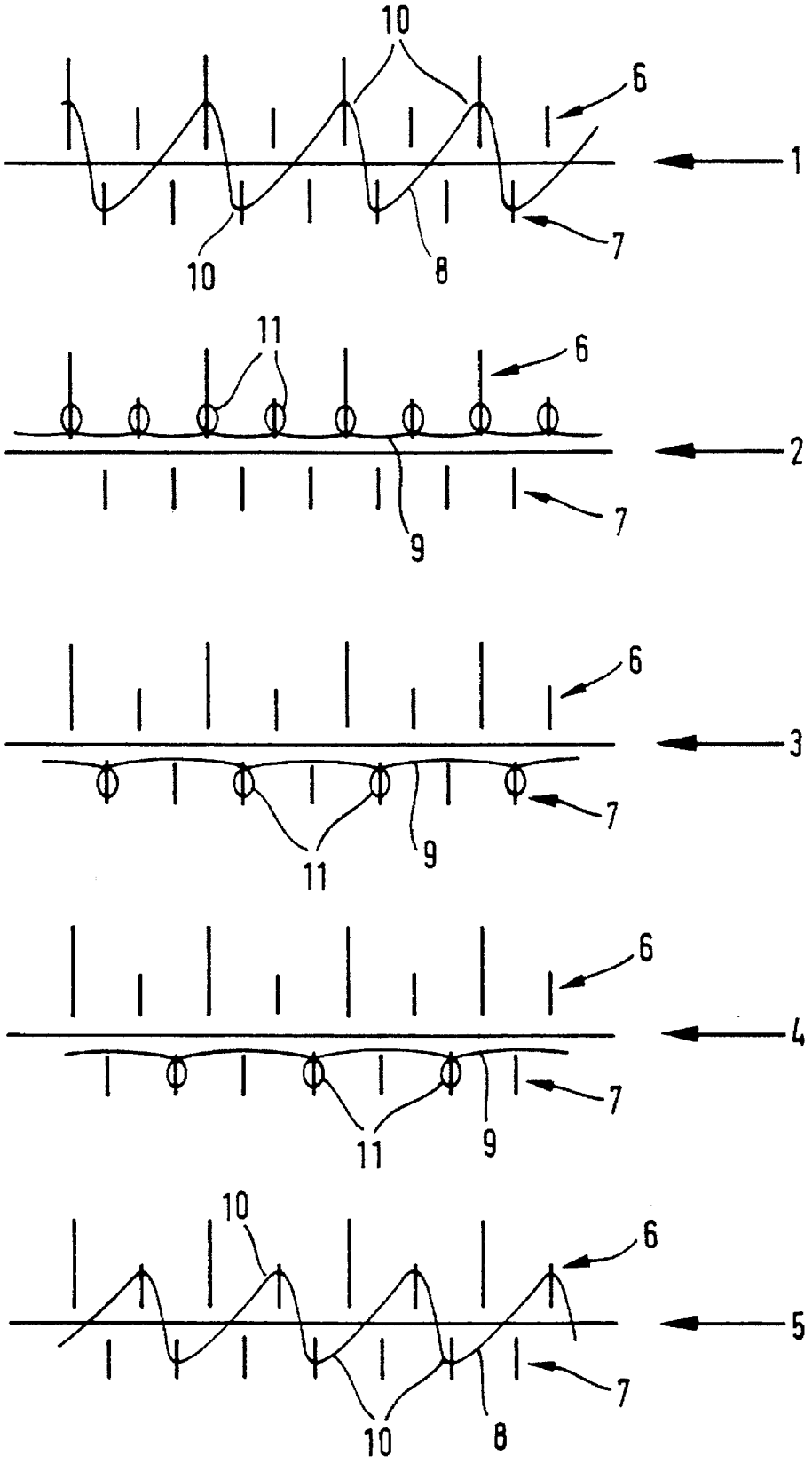
Figure 4B:
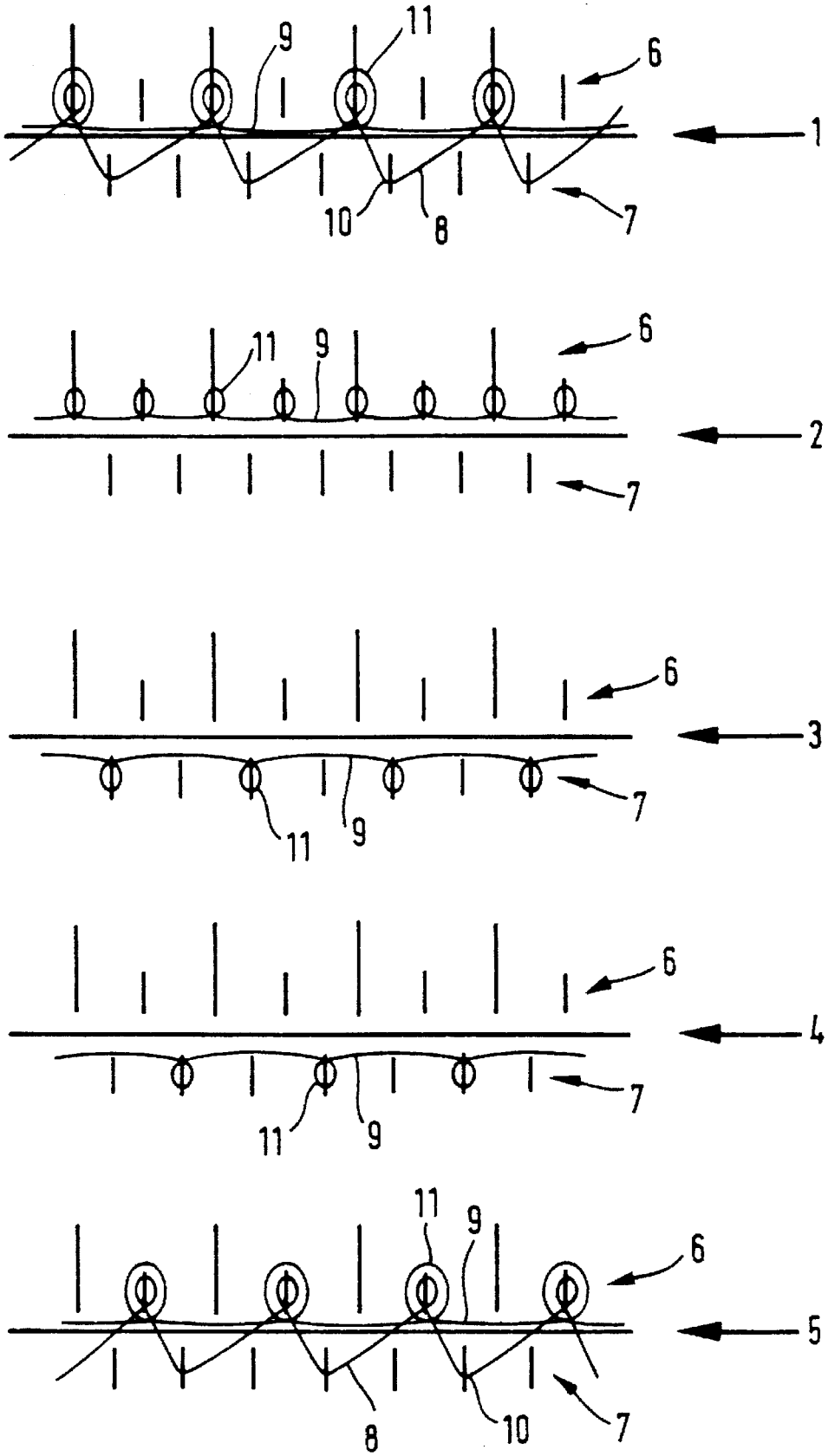

The schemes depicted in FIGS. 4*a* and 4*b* illustrate the steps of producing a double-face circular knit according to the present invention by way of example. In said drawings, five groups (1, 2, 3, 4, 5) of short vertical lines (6, 7) are arranged one above the other and are each divided by a horizontal line to symbolize the needles of five systems of the knitting machine with the group (6) of lines above the horizontal line representing the dial needles and the group (7) of lines below the horizontal line representing the cylinder needles. The lines (8, 9) leading from needle to needle symbolize the path of the thread, a simple deflection (10) of the course of the thread at the needle denoting an interlacing of the thread in question while a loop (11) around the needle denotes intermeshing.

The lines (8) in these drawings represent the course of the spacer thread on systems 1 and 5, and the lines (9) indicate the course of the threads for the back of the material on system 2 and the face of the material on systems 3 and 4, where the needles are guided in Jacquard fashion.

In this example, the spacer thread on the fifth system is shogged by one needle compared with the first system.

If coarse-filament multifilament yarn is used as spacer thread, it is preferable to use textured yarns. They can be air or false twist textured.

Preferably the needles are controlled in such a way as to produce a plain structure in each of the lengths of web.

In line with the above-described preferred composition of the spacer structure it is preferable for the yarn supply to be such that from 50 to 80% by weight, preferably from 60 to 70% by weight, of the spacer threads are optionally textured coarse-filament multifilament yarn and correspondingly from 20 to 50% by weight, preferably from 30 to 40% by weight, are monofilaments.

If monofilaments and multifilament yarns are to be used side by side as spacer threads, it is advantageous to control needle selection in such a way, depending on the desired, above-described arrangement of the monofilaments and of the optionally textured multifilament yarns in the spacer structure, that spacer threads composed of monofilaments and optionally textured multifilaments form side-by-side courses in the longitudinal direction or in such a way that spacer threads composed of monofilaments and optionally textured multifilaments alternate with each other viewed in the longitudinal direction.

Particular stabilization against sideways slippage and collapse of the two lengths of knit web results on controlling the construction in such a way that spacer threads composed of monofilaments and optionally textured multifilaments alternate between the longitudinal chains of loops.

As mentioned earlier, the double-face circular knit of the present invention possesses very favorable formability and pleasant tactile properties of the textile surface and is easily recyclable, in particular when all the fiber materials are made of the same polymer material.

It can therefore be used with particular advantage for upholstering and lining interior spaces, for example automotive interiors, or, especially when a flame-resistant polyester is used for producing the multifilament and monofilament yarns, aircraft cells, high speed train compartments or public spaces.

What is claimed is:

1. A double-face circular knit consisting essentially of two concentric lengths of knit web and an in-between spacer structure, wherein 50 to 80% by weight of the spacer threads are textured coarse-filament multifilament yarns, and correspondingly from 20 to 50% by weight are monofilaments, the distance between the two lengths of knit web is from 0.3 to 8 mm, the stitch density corresponds to a machine gauge from E 16 to E 32, and the density of the spacer threads is between 150 and 250 threads per $cm^2$.

2. The double-face circular knit of claim 1, wherein the optionally textured coarse-filament multifilament yarns have a yarn linear density from 50 to 250 dtex and a filament linear density from 5 to 100 dtex.

3. The double-face circular knit of claim 1, wherein the monofilaments have a linear density from 20 to 150 dtex.

4. The double-face circular knit of claim 1, wherein all the yarns are made of polymer materials.

5. The double-face circular knit of claim 1, wherein the polymer of the yarns is a polyester or a polyolefin.

6. The double-face circular knit of claim 5, wherein the polyester is polyethylene terephthalate.

7. The double-face circular knit of claim 1, wherein the knit has a basis weight from 150 to 1400 $g/m^2$.

8. The double-face circular knit of claim 1, wherein the monofilaments and the optionally textured yarns of the spacer structure are interlaced side by side in every course.

9. The double-face circular knit of claim 1, wherein the monofilaments and the optionally textured yarns of the spacer structure alternate.

10. A process for producing a double-face circular knit as claimed in claim 1 by producing, on a circular knitting machine with a plurality of independently movable needles in two rows of a cylinder and a dial, a double-faced circular knit in which spacer threads are guided alternatingly back and forth between the two lengths of knit web and are interlaced or intermeshed into each length of web, which comprises the step of feeding the needles with spacer threads comprising either coarse-filament multifilament yarns or coarse-filament multifilament yarns alternating with monofilaments.

11. The process of claim 10, further comprising the step of supplying yarn such that from 50 to 80% by weight of the spacer threads are coarse-filament multifilament yarn and correspondingly from 20 to 50% by weight are monofilaments.

12. The process of claim 10 wherein the needles are controlled in such a way as to produce a plain structure in each of the lengths of web.

13. A method of upholstering and lining interior spaces comprising the steps of forming a double-face circular knit as claimed in claim 1, and applying said double-face circular knit as upholstering or a liner for an interior space.

14. The double-face circular knit as claimed in claim 4, wherein all the yarns are made of the same polymer materials.

15. The double-face circular knit as claimed in claim 1, wherein from 60 to 70% by weight of the spacer threads are coarse-filament multifilament yarn and correspondingly from 30 to 40% by weight are monofilaments.

16. The process of claim 10, wherein the yarn supply is such that from 60 to 70% by weight of the spacer threads textured coarse-filament multifilament yarn and correspondingly from 30 to 40% by weight are monofilaments.

17. A double-face circular knit as claimed in claim 1, wherein the coarse-filament multifilament yarns are combined with monofilaments.

18. A double-face circular knit consisting essentially of two concentric lengths of knit web and an in-between spacer structure, wherein 50 to 80% by weight of the spacer threads are textured coarse-filament multifilament yarns, and correspondingly from 20 to 50% by weight are monofilaments, the distance between the two lengths of knit web is from 0.3 to 8 mm, the stitch density corresponds to a machine gauge from E 16 to E 32, and the density of the spacer threads is between 150 and 250 threads per $cm^2$, wherein the textured coarse-filament multifilament yarns have a yarn linear density from 50 to 250 dtex and a filament linear density from 5 to 100 dtex.

* * * * *